US010267589B1

(12) United States Patent
Snook

(10) Patent No.: US 10,267,589 B1
(45) Date of Patent: Apr. 23, 2019

(54) RISER CAM BOW

(71) Applicant: Nicholas Snook, Lyme, NH (US)

(72) Inventor: Nicholas Snook, Lyme, NH (US)

( * ) Notice: Subject to any disclaimer, the term of this patent is extended or adjusted under 35 U.S.C. 154(b) by 0 days.

(21) Appl. No.: 15/698,718

(22) Filed: Sep. 8, 2017

Related U.S. Application Data

(63) Continuation-in-part of application No. 14/712,226, filed on May 14, 2015.

(60) Provisional application No. 61/993,625, filed on May 15, 2014.

(51) Int. Cl.
*F41B 5/10* (2006.01)
*F41B 5/00* (2006.01)

(52) U.S. Cl.
CPC ..... *F41B 5/10* (2013.01); *F41B 5/105* (2013.01); *F41B 5/0094* (2013.01)

(58) Field of Classification Search
CPC ..... F41B 5/10; F41B 5/105; F41B 5/0094; Y10S 124/90
USPC ..... 124/25.6, 900
See application file for complete search history.

(56) References Cited

U.S. PATENT DOCUMENTS 3,923,035 A * 12/1975 Trotter ..... F41B 5/10 124/25.6
3,967,609 A * 7/1976 Frydenlund ..... F41B 5/10 124/25.6
4,461,267 A * 7/1984 Simonds ..... F41B 5/10 124/25.6
4,512,326 A * 4/1985 Jarrett ..... F41B 5/10 124/25.6
4,817,580 A * 4/1989 Butterfield ..... F41B 5/10 124/25.6
4,858,588 A * 8/1989 Bozek ..... F41B 5/0094 124/23.1
5,054,463 A * 10/1991 Colley ..... F41B 5/10 124/25.6
5,535,727 A * 7/1996 Helmuth ..... F41B 5/10 124/25.6
6,112,732 A * 9/2000 Larson ..... F41B 5/10 124/25.6
6,360,735 B1 * 3/2002 Larson ..... F41B 5/10 124/25.6
6,776,148 B1 * 8/2004 Islas ..... F41B 5/10 124/25.6
7,047,958 B1 * 5/2006 Colley ..... F41B 5/10 124/25.6
8,387,603 B2 * 3/2013 Darlington ..... F41B 5/10 124/23.1
8,522,762 B2 * 9/2013 Trpkovski ..... F41B 5/0094 124/23.1
8,833,349 B2 * 9/2014 Park ..... F41B 5/0094 124/25.6

(Continued)

*Primary Examiner* — Alexander Niconovich
(74) *Attorney, Agent, or Firm* — John J. Elnitski, Jr.

(57) ABSTRACT

The present invention is a riser cam bow having a first bow limb and second bow limb extending respectively from a first and second riser end. Each bow limb having a first end and a second end, said first end of said each bow limb being attached to the riser end. Each bow limb attached to each first riser end in a reverse manner, where the first end of each bow limb attaches to an outside surface of each riser end so that each bow limb follows along said outside surface of each riser end towards a middle of each riser and travels past the outside surface and an inside surface such that each second end of each bow limb is between the inside surface and the user.

10 Claims, 23 Drawing Sheets

(56) References Cited

U.S. PATENT DOCUMENTS

| | | | | |
|---|---|---|---|---|
| 9,297,604 | B1 * | 3/2016 | Sidebottom | F41B 5/123 |
| 9,441,907 | B1 * | 9/2016 | Obteshka | F41B 5/105 |
| 9,752,842 | B1 * | 9/2017 | Huang | F41B 5/1403 |
| 2007/0101980 | A1 * | 5/2007 | Sims | F41B 5/10 124/25.6 |
| 2014/0069405 | A1 * | 3/2014 | Peacemaker | F41B 5/10 124/25.6 |
| 2014/0190460 | A1 * | 7/2014 | Langley | F41B 5/105 124/25.6 |
| 2014/0261358 | A1 * | 9/2014 | Pulkrabek | F41B 5/105 124/25.6 |

* cited by examiner

SECTION THROUGH RISER LOOKING TOWARD ARM

RISER CAM BOW

This application is a Continuation In Part of U.S. application Ser. No. 14/712,226 and claims the benefit of and incorporates by reference U.S. application Ser. No. 14/712,226 filed May 14, 2015 and U.S. Provisional Application No. 61/993,625, filed May 15, 2014.

BACKGROUND

The present invention generally relates to archery bows. More specifically, the present invention relates to archery bows using cams.

Most compound bows attach the cams to the end of the bow limbs. With the cams at the end of the bow limbs there has an increase in bow speed, but over the past 10 years arrow speeds have not exceeded the 350 fps. There seems to be a limit based on the size of the cams and the amount of energy they can store, based on how much energy an archer can put into the draw of the bow. 80 lbs is usually the limit for bow manufacturers. Only a very small percentage of archers can pull an 80 lb bow through current cam systems on a bow. Most use hunting bows are in the 50 to 60 lb range. The advertised high speeds are only for the very few. More and more efficient cams are designed and introduced to the archery market. But because of the way the components are arranged on a bow, none have overcome the limit of 350 fps. The problem is that the size of the cam on the bow limb is limited for various reasons. The extreme acceleration and deceleration involved by placing cams on the ends of the bow limb limit the size and weight of the cam, which must survive the constant shock resulting from being mounted on the end of the bow limb when it is shot. Also adding extra weight to the end of a bow limb gets into "polar moment of inertia" issues. The more mass placed on the end of the bow limb will increase the resistance to acceleration as well as require heavier more durable mounting materials which would in turn increase the polar moment of inertia issue.

It is an object of the present invention to provide an archery bow that is easier to use.

SUMMARY OF THE INVENTION

The present invention is a riser cam bow with an independent timing cam system for archery. The present invention addresses this issue by removing the cams from the bow limb and mounting them on an appendage incorporated into the riser.

DETAILED DESCRIPTION

Figure 9:
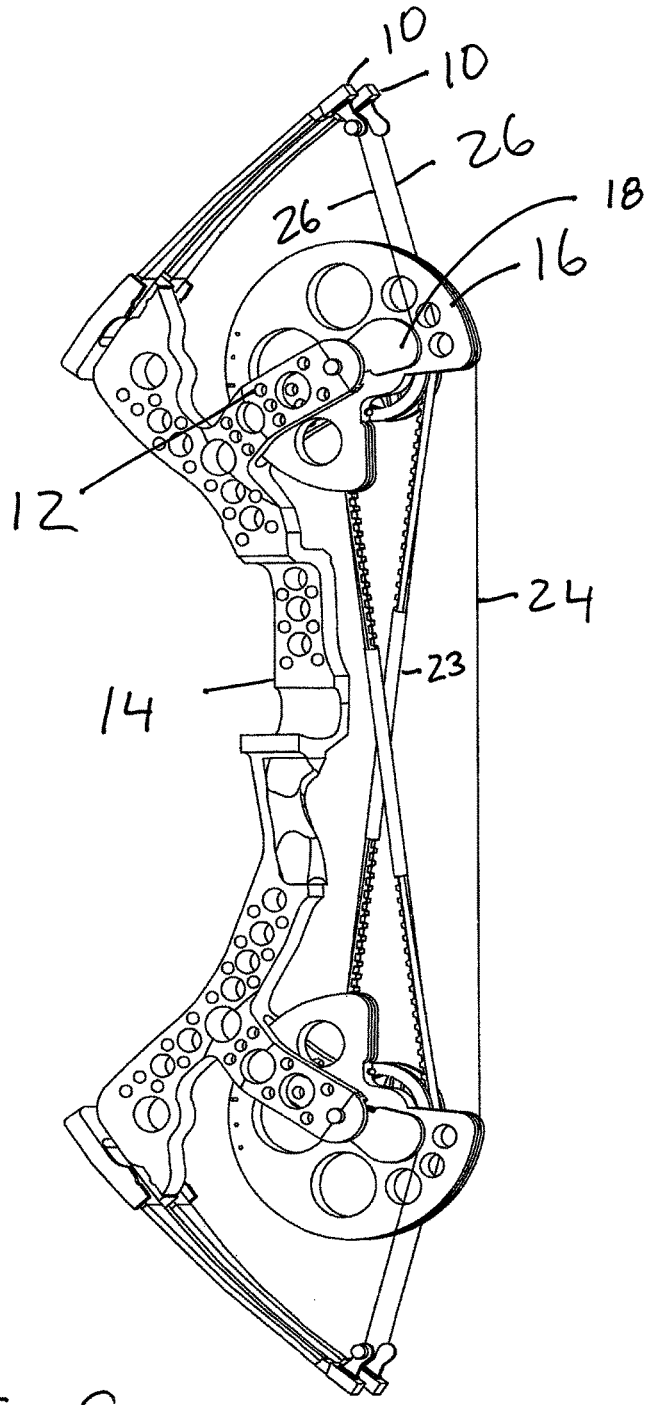
FIG. 9 is a side view of a bow according to the present invention.
Figure 10:
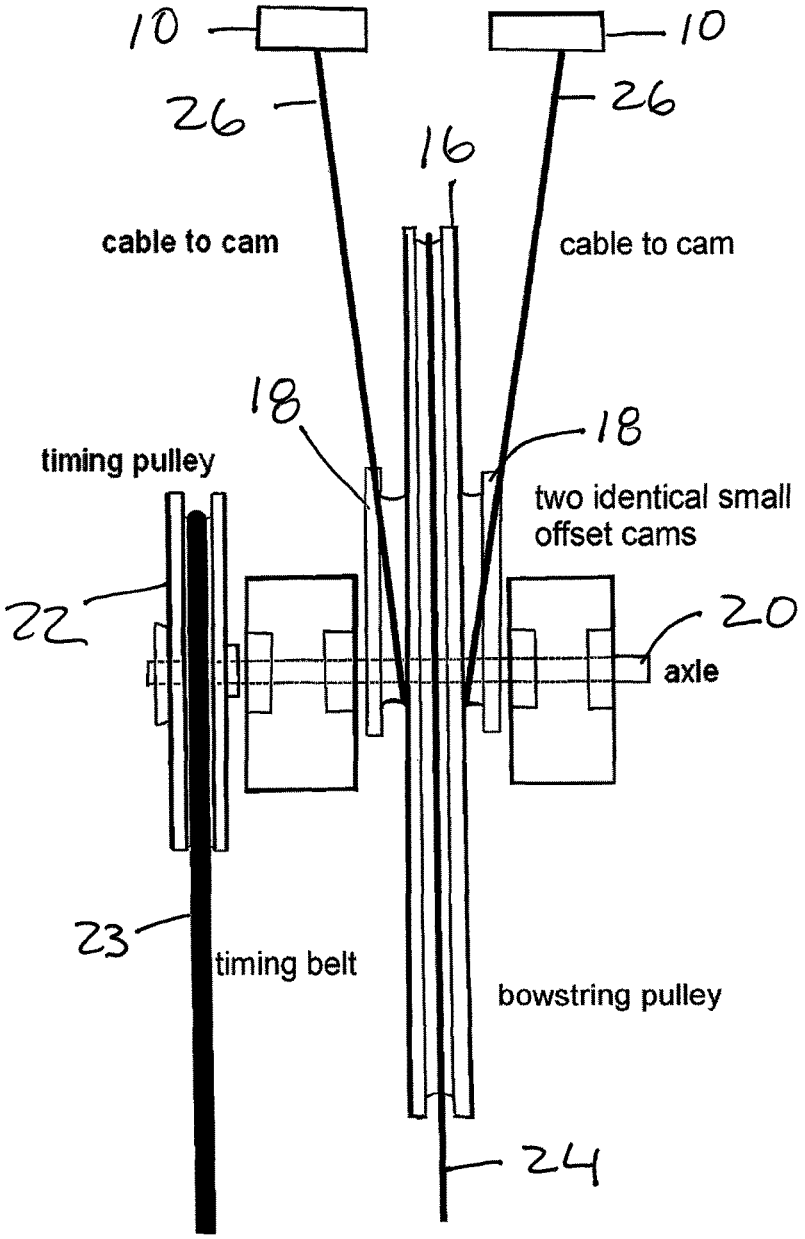
FIG. 10 is an end view of a bow according to the present invention.

The present invention is a riser cam bow with an independent timing cam system for archery. The present invention addresses this issue by removing the cams from the bow limb 10 and mounting them on an appendage 12 incorporated into the riser 14, as show in FIGS. 1-10. FIGS. 1-8 show limbs with a single end and FIGS. 9-10 show limbs 10 with a split end. First of all, a larger cam can be used, which in turn enables the archer to apply more force to compress the bow limbs 10. Secondly, the moment of polar inertia issue is reduced at the bow limbs 10 and enables them to accelerate faster. The larger and sturdier cam can be mounted in ball or roller bearings reducing friction. From my experiments, a bow using the present invention can be designed to enable archers to draw bows in excess of 100 lbs.

The cams of current compound bows consist of two parts, a large cam that the bowstring connects to and a smaller cam that connects to the bow limb. The cams use a timing system where the cam on one bow limb is connected to the opposing bow limb with a cable. Cross connecting of cables cause problems in the performance of bows. Since the cables cross directly in the path of where the arrow travels, they require a cable guard system that draws the cables out of the way of the path of the arrow. This creates a tuning issue where the angular pull on the cams located at the end of the bow limbs tends to cause cam lean and reduces the performance and accuracy of the bow. The angled timing cables in turn cause a bow to torque along its vertical axis when it is shot, reducing accuracy. The present invention reconfigures the entire cam system into a more direct and simple method. The riser cam bow includes a large bowstring cam 16 for the bowstring on each appendage 12 and two matching power cams 18 mounted on either side of the bowstring cam 16. The power cams 18 attach to the nearest bow limb 10 rather than to the opposing bow limb 10. The bowstring cam 16 and power cam 18 are mounted to an axle 20, along with a timing wheel 22 attached to one end of the axle 20. The bowstring cam 16, power cams 18, timing wheel 22 and axle 20 are mounted onto the appendage 12 of the bow using a bearing system to form a limb cam unit. The limb cam unit has all of its parts locked in unison and is mounted in a forked appendage 12 of the riser so that it rotates as a result of bearings supporting the axle 20 in the forks. The timing system of the riser cam bow uses two timing wheels 22 attached to the axle 20 of each limb cam units and linked by a timing belt 23 with teeth. The belt 23 has a single twist in it that enables the limb cam units to rotate in opposite directions. This timing system keeps the cams synchronized independently of the other bow components. Since timing system is independently synchronized, there is only a need to attach simple cables from the power cam 18 directly to the bow limb 10, with no pulleys on the bow limb 10. The timing system of the riser cam bow eliminates the need for cross cables and all the issues of cable wear and stretch and synchronization. This system allows the timing belt to be out of the path of the arrow without distorting any forces and eliminates the total cross cabling found in current compound bows and also eliminates the cable guard entirely.

The drawstring 24 on the riser cam bow is a simple bowstring like found on longbows and recurve bows. Just a string with two loops connected to the bowstring cams 16, instead of the complex cables and Y harnesses of conventional compound bows. The cables 26 that attach to the bow limbs 18 are smaller bow strings, which are just short strings with loops at each end. The drawstring 24 rotates the bowstring cam 16 when pulled, but has no influence on the timing. Even if you pull the drawstring 24 from a point that is not centered, the power cams 18 will compress the bow limbs 10 equally. Even if one bow limb 10 is disconnected from the system and the drawstring 24 is drawn, the remaining bow limb 10 is compressed, as if the disconnected limb 10 was attached. When the drawstring 24 is released, the energy from each bow limb 10 is equally applied to the drawstring 24 because of the power cams 18 being synchronized to each other by the timing belt. FIG. 10 shows an end view of the bow string cam 16 and power cams 18 connected to a split end limb 10. In FIG. 10, the timing wheel 22 is labeled as the timing pulley, the power cams 18 are labeled as the offset cams, the bowstring cam 16 is labeled as the bowstring pulley. The drawstring 24 is shown as a line wrapped around the bowstring pulley.

With most conventional compound bows, "cam lean" is a big issue. Cam lean happens when the Y cables attached to the cam axle are not adjusted equally, allowing the bow limb to twist and result in a decrease in accuracy. The cams on riser cam bow eliminate the issue of cam lean, because of their placement on the rigid riser instead of the bow limbs. The cam system of the present invention allows for changing the performance of the bow by simply removing the two power cams from the bowstring cam and replacing them with a different size or shape power cam. Depending on performance requirements of the shooter soft, medium, or hard setting cams can simply be bolted to the large drawstring cam. Virtually any modern cam design existing in the industry could be adapted to work on this system. The riser cam bow can be maintained by most archers without any special tools or equipment, because of its simplicity. In the manufacturing process the simplicity of construction of the riser cam bow reduces manufacturing costs, as well as the simplicity of the bowstrings and cam cables reduces production costs.

Nock travel is a problem found in most modern compound bows, as a result of either improperly timed cams or stretching of cables that cause vertical nock movement when the bow is shot or lateral nock movement as a result of the timing cables being pushed off center by the cable guard which causes the bow to torque when shot. The system of the riser cam bow prevents the vertical nock movement with the timing belt and because there is no cable guard involved, lateral nock movement is prevented. This is because the components of the riser cam bow are aligned with the center axis of the riser 14 and the power cables 18 are symmetrically balanced on either side resulting in all of the forced directed along the center line on the riser cam bow. The riser cam bow includes a draw stop. The draw stop uses a pin on the large cam that comes in contact with a block on the riser appendage that holds the cam. This insures a consistent draw every time the bow is shot. The point on the timing belt where there is contact due to the twist could reduce the bow speed. Therefore, both parts of the timing belt is wrapped with a split belt tube composed of nylon, teflon, or some type of friction reducing plastic. The belt tubes are secured to the timing belt so that they do not move. The belt tubes are long enough to travel up and down against each other when the bow is drawn and released in order to prevent the rubber belt from contacting itself to reduce wear and friction.

Figure 11:
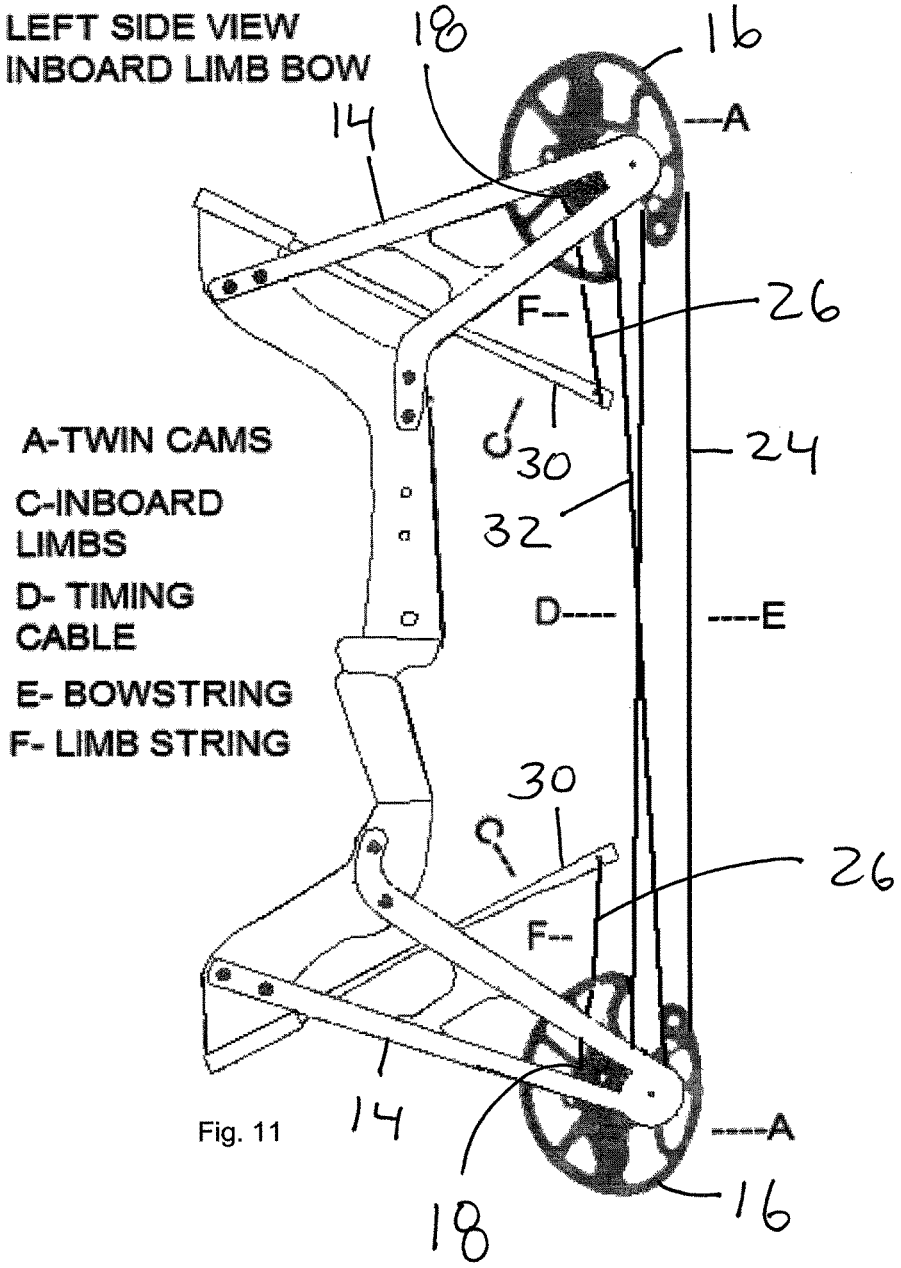
FIG. 11 is a side view of a bow according to the present invention.
Figure 12:
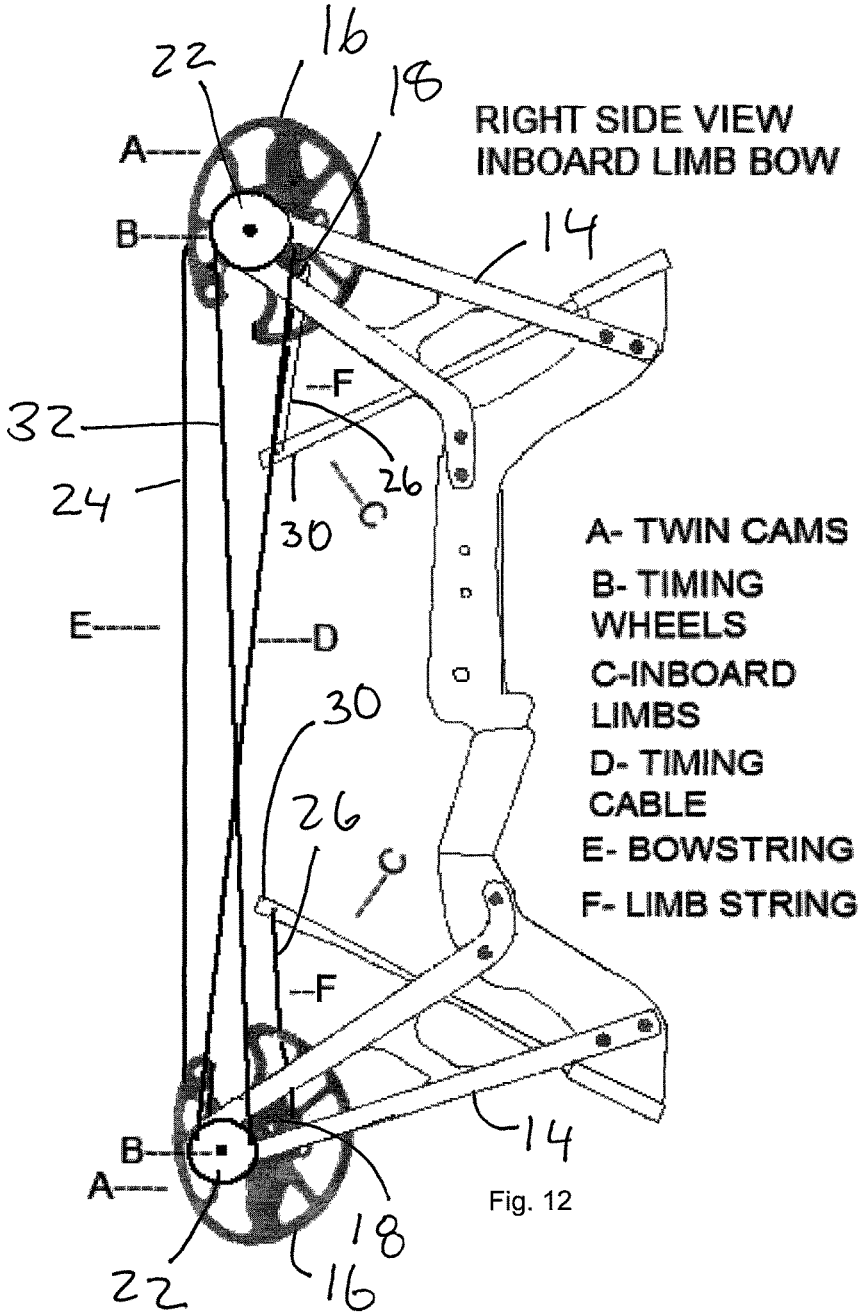
FIG. 12 is a side view of a bow according to the present invention.

FIGS. 11-12 show another embodiment of a bow with the timing system which incorporates inboard limbs 30 and a timing cable 32 rather than the timing belt 23 used in the first embodiment. By placing the limbs 10 inboard, the cams can be moved to a more outboard position as compared to the first embodiment. By placing the limbs 10 inboard and placing the cams outboard, it allows for a longer axle to axle chord length of the drawstring 24. The longer chord length makes for a more efficient draw of the bow a more forgiving launch of the arrow.

Figure 1:
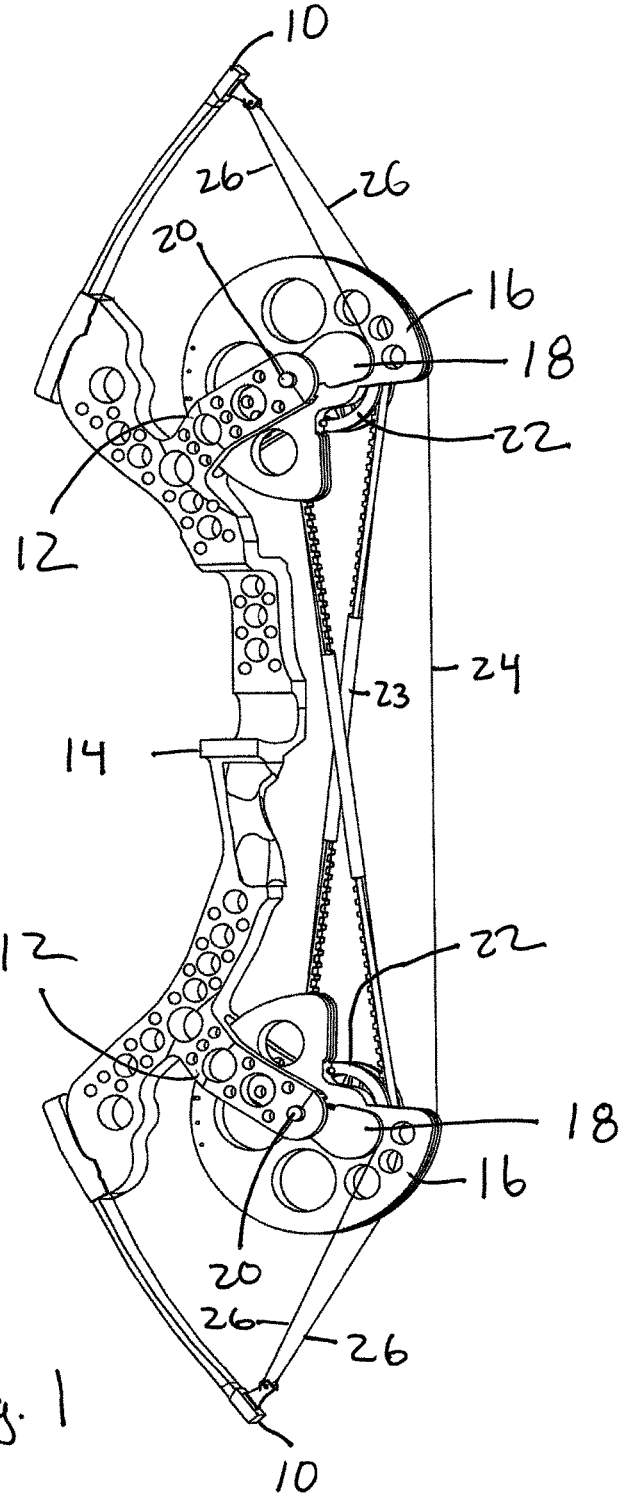
FIG. 1 is a side view of a bow according to the present invention.
Figure 2:
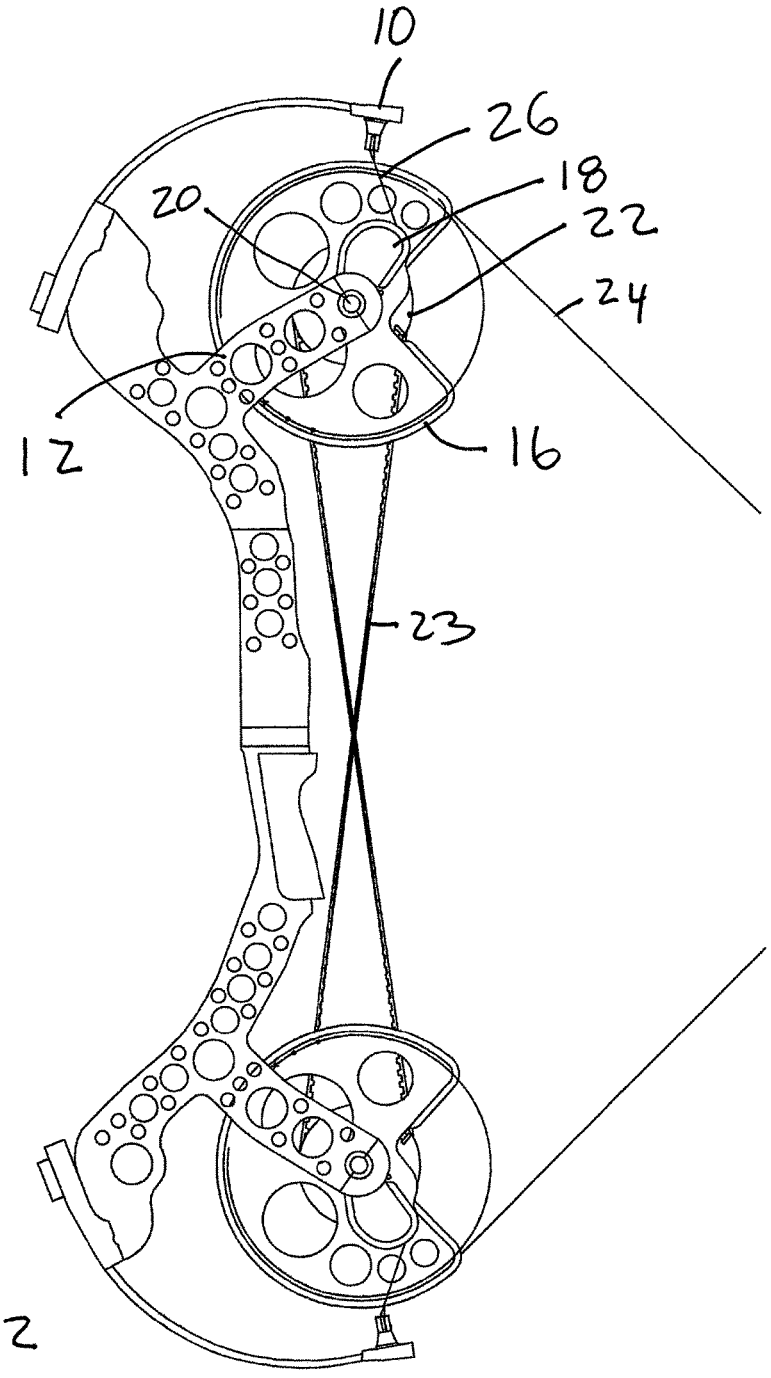
FIG. 2 is a side view of a bow according to the present invention.
Figure 3:
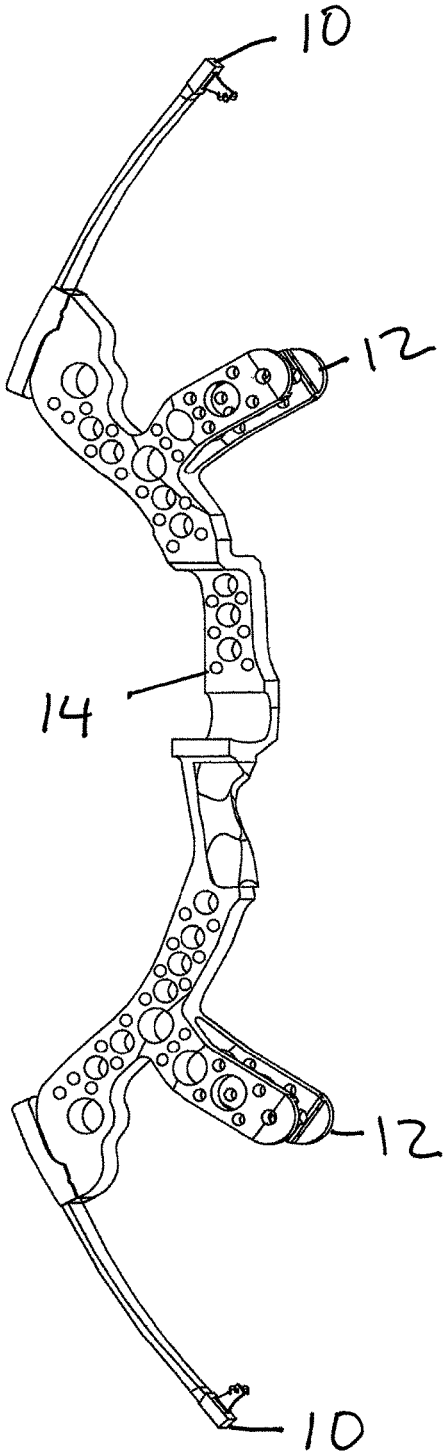
FIG. 3 is a side view of a bow according to the present invention.
Figure 4:
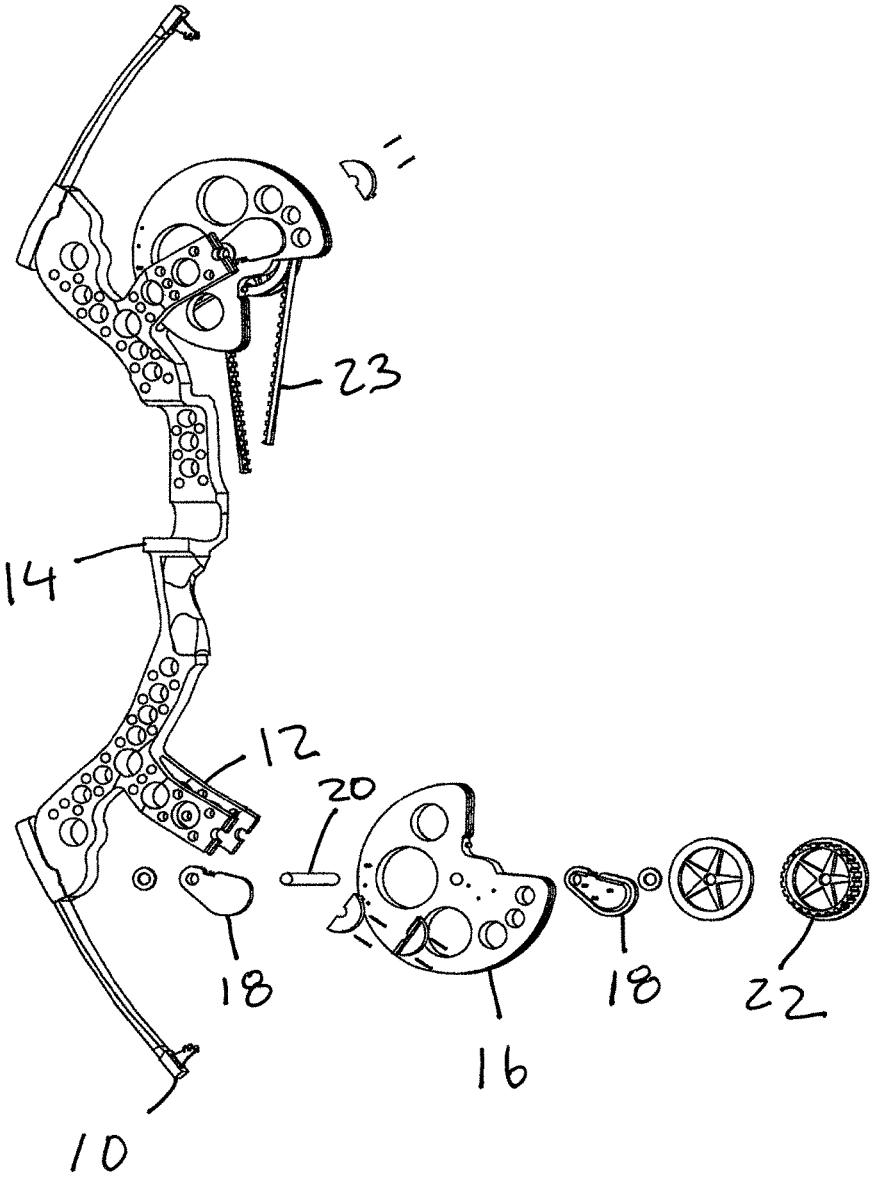
FIG. 4 is a side view of a bow according to the present invention.
Figure 5:
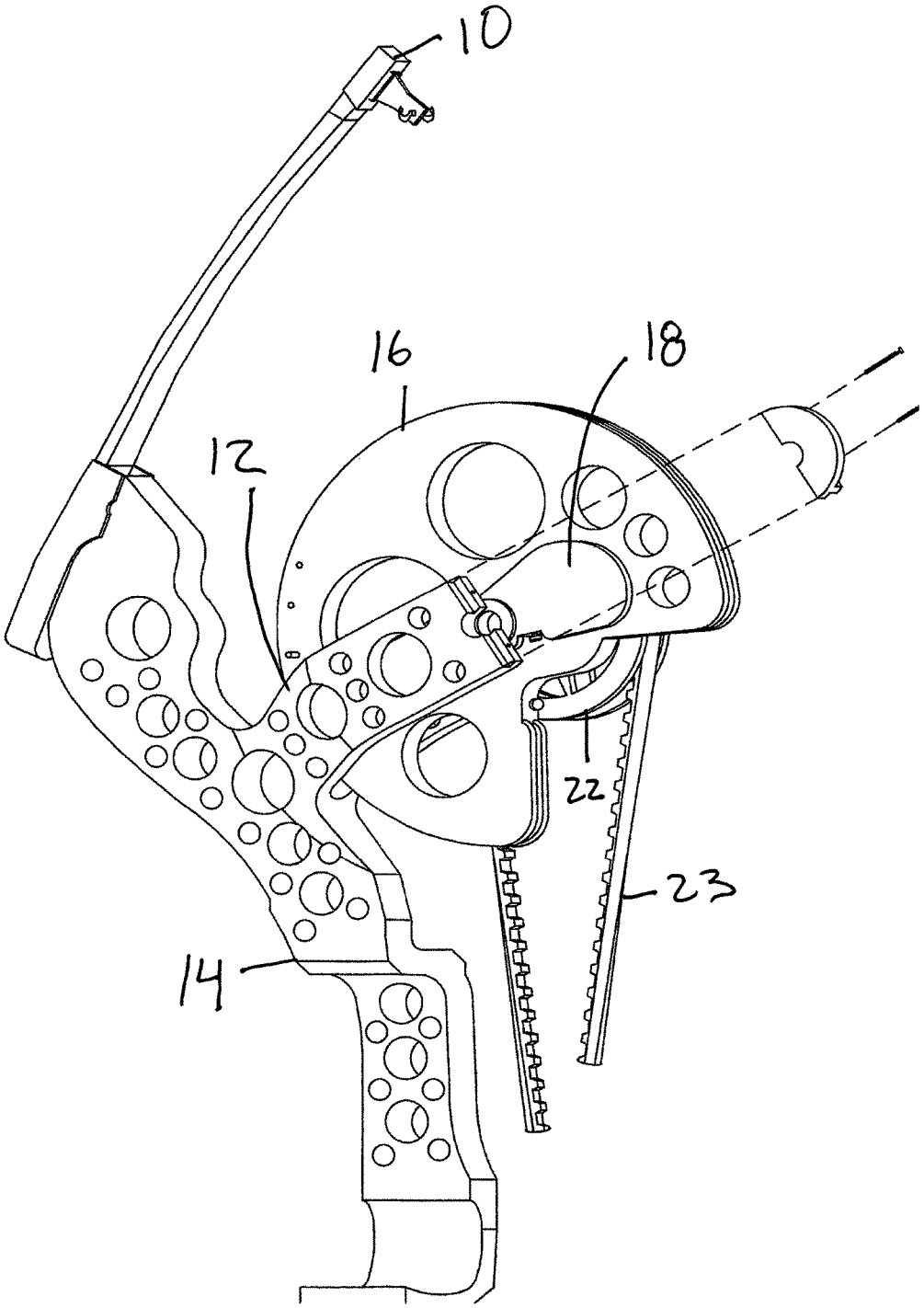
FIG. 5 is a side view of a bow according to the present invention.
Figure 6:
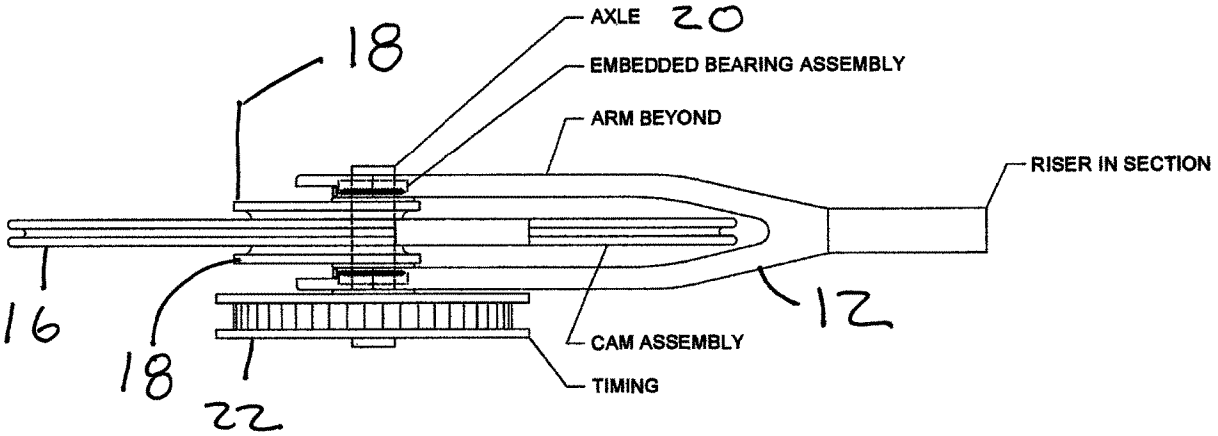
FIG. 6 is an end view of a bow according to the present invention.
Figure 7:
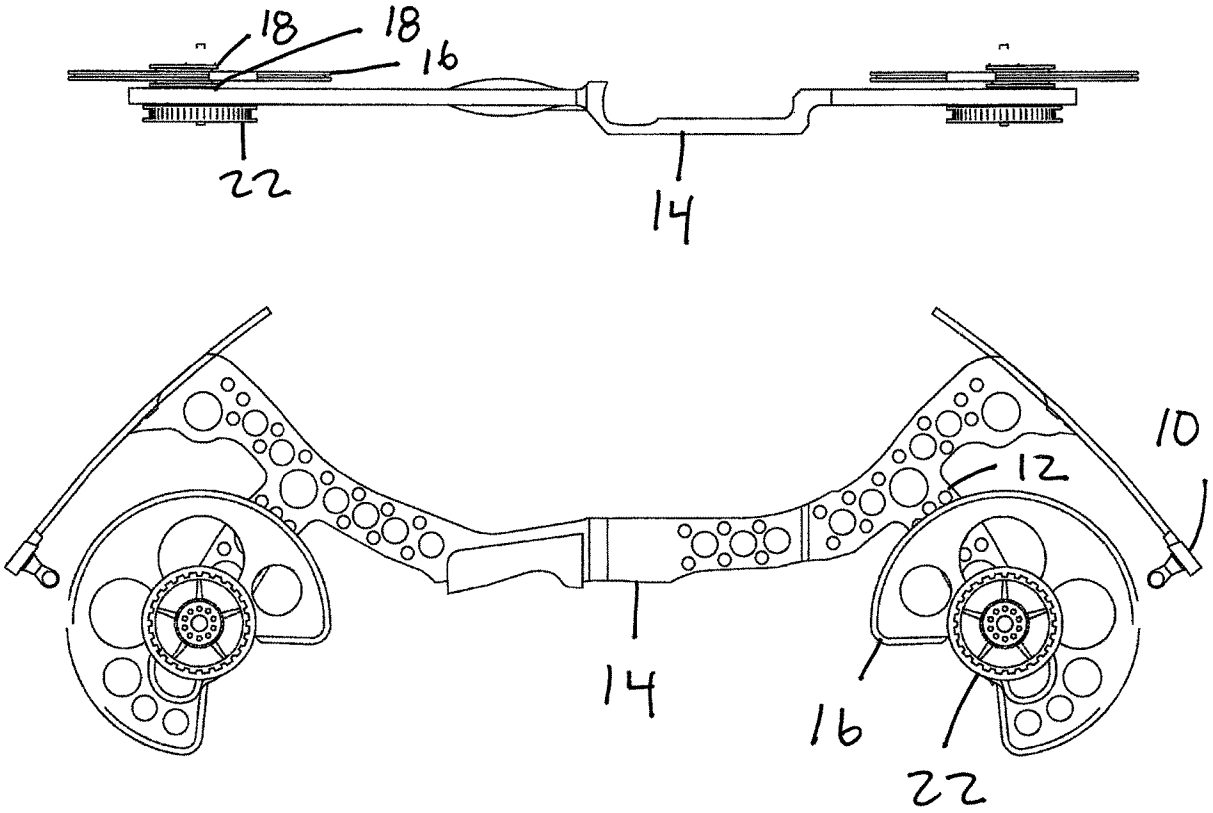
FIG. 7 is a side view of a bow according to the present invention.
Figure 8:
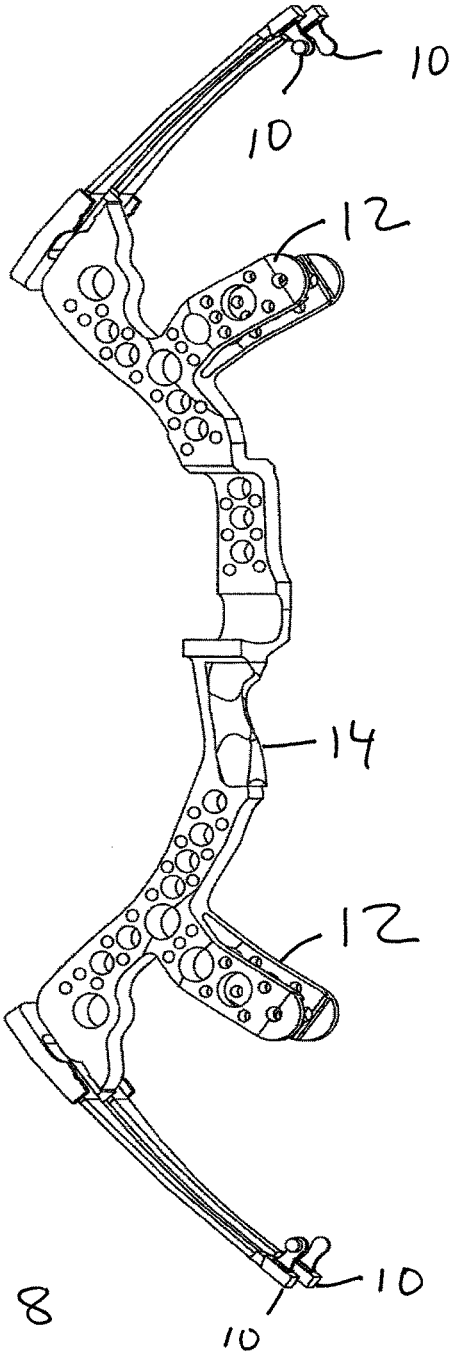
FIG. 8 is a side view of a bow according to the present invention.
Figure 13:
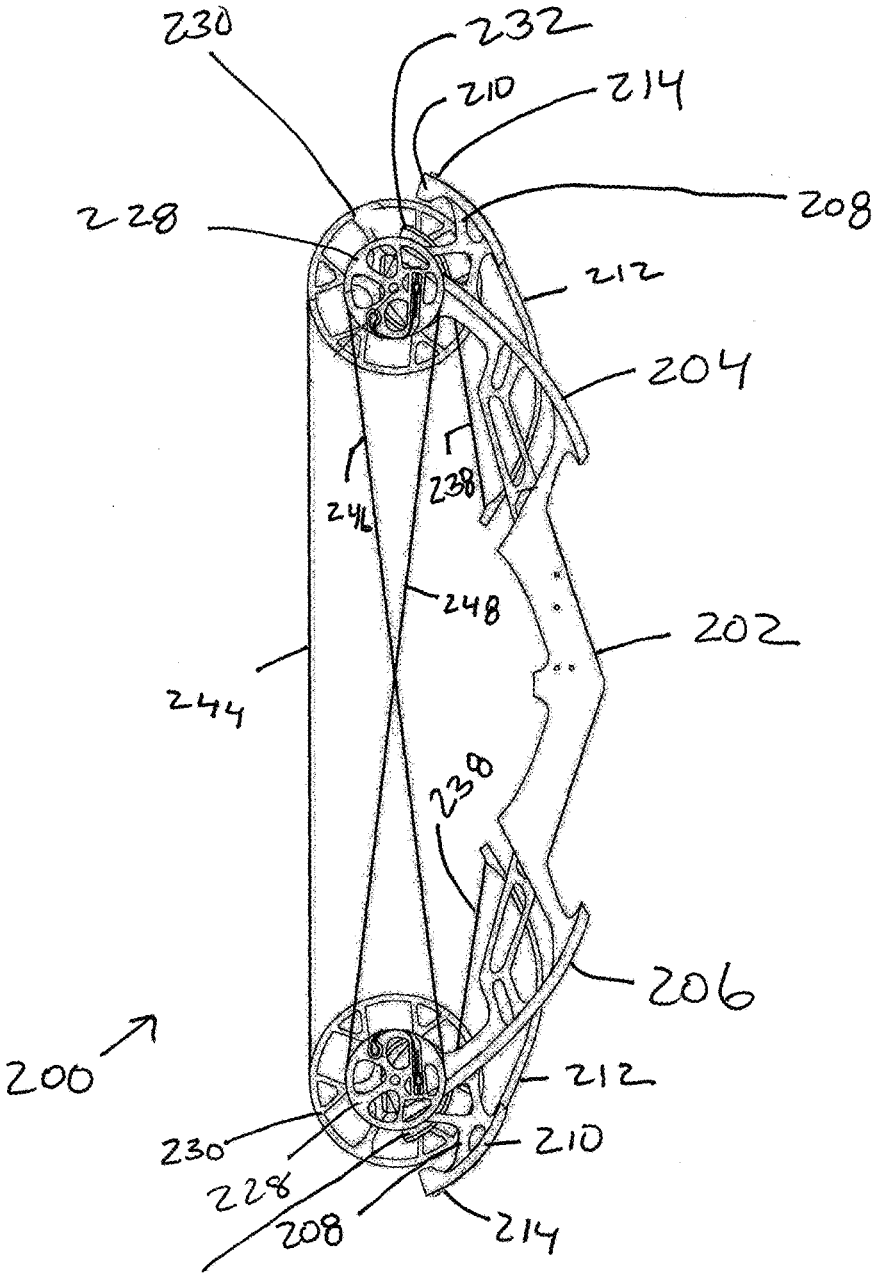
FIG. 13 is a side view of a bow according to the present invention.
Figure 14:
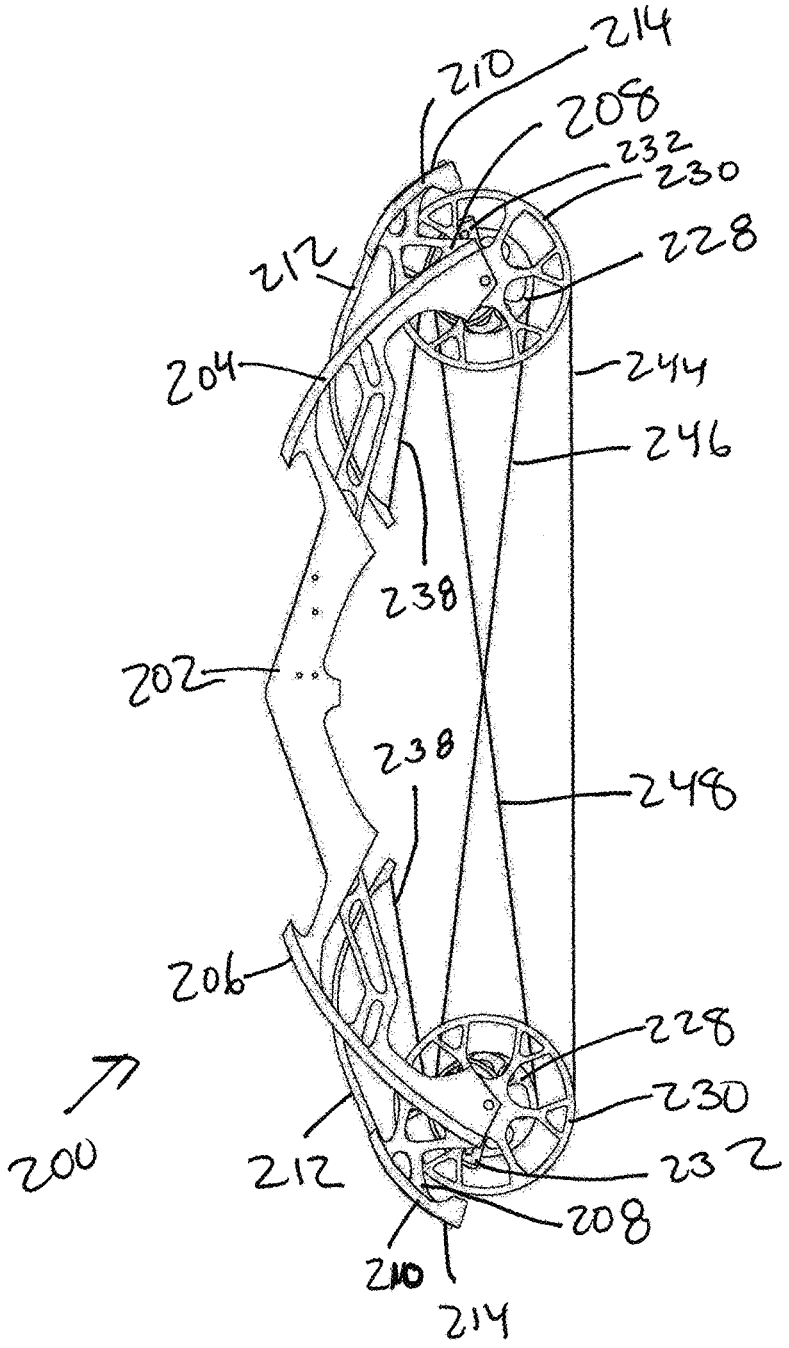
FIG. 14 is a side view of a bow according to the present invention.
Figure 15:
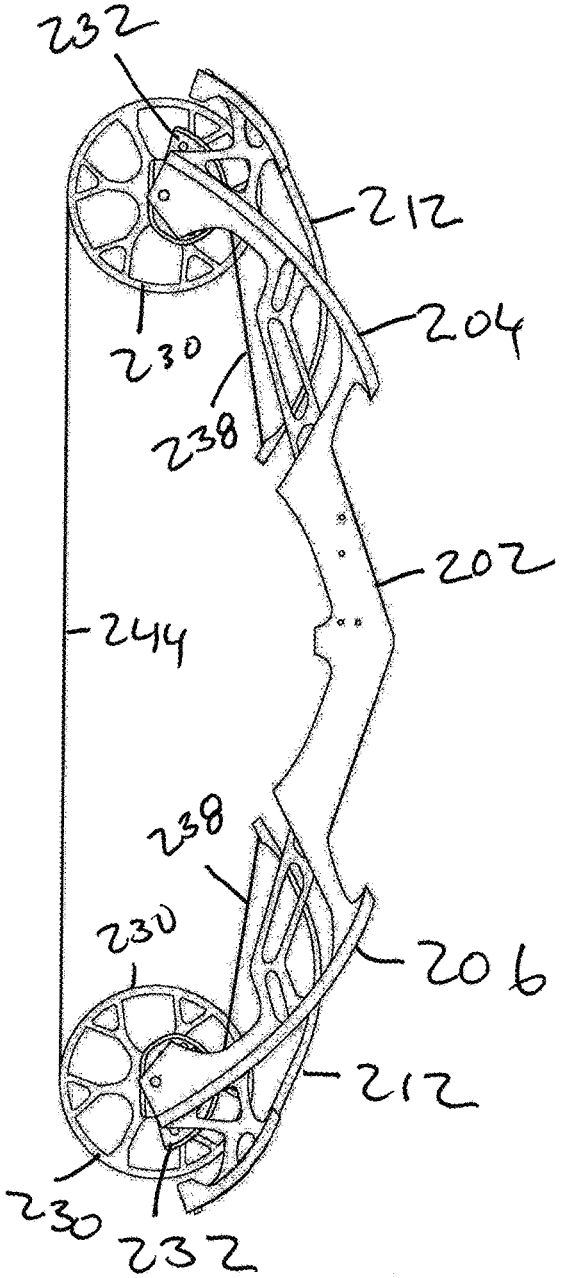
FIG. 15 is a side view of a bow according to the present invention.
Figure 16:
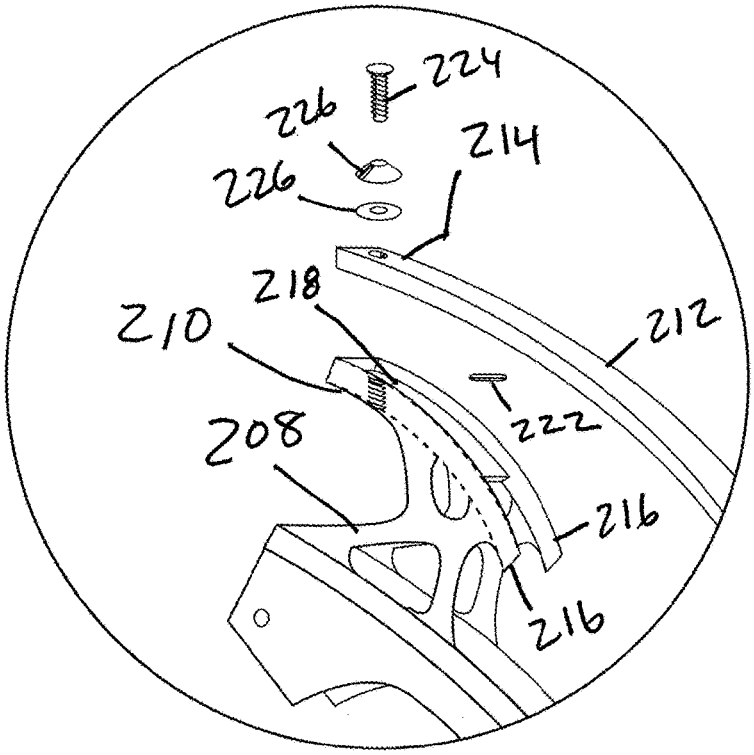
FIG. 16 is a partial exploded view of a bow according to the present invention.
Figure 17:
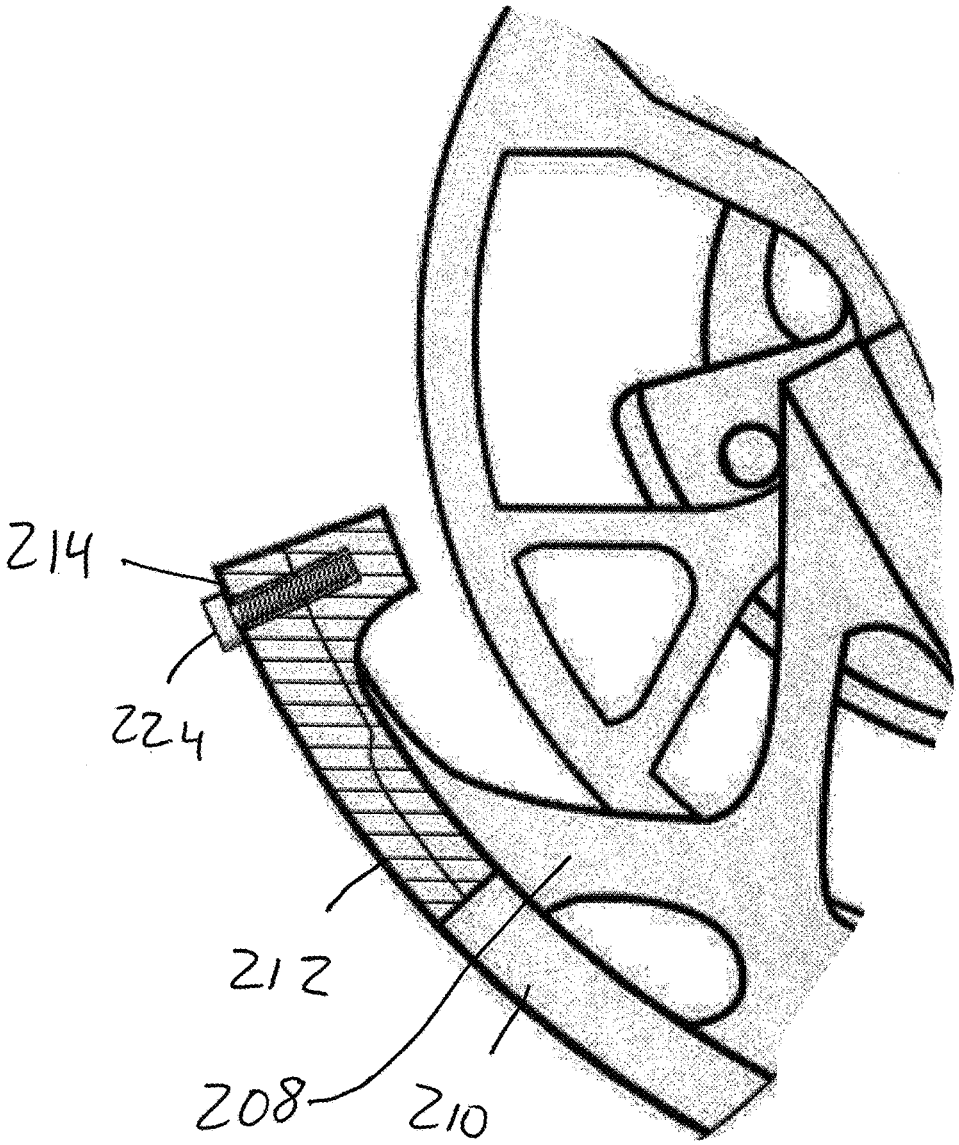
FIG. 17 is a partial side view of a bow according to the present invention.

FIGS. 13-23 show another embodiment of the riser cam bow with an independent timing cam system. The riser cam bow 200 includes a riser 202 with a first end 204 and a second end 206, as shown in FIGS. 1-3. The riser cam bow 200 includes a first cam-timing assembly and a first bow limb assembly on the first end 204 of the riser 202 and a second cam-timing assembly and a second bow limb assembly on the second end 206 of the riser 202, as shown in FIGS. 13-14. Each bow limb assembly includes a limb bracket 208, limb pocket 210 and bow limb 212. The limb bracket 208 mounts to the riser 202. The limb pocket 210 is mounted to the limb bracket 208, where the limb bracket 208 provides support for the limb pocket 210. The bow limb 212 mounts to the limb pocket 210 in a reverse manner compared to typical bow limbs, where the bow limb 212 starts at the end 214 of the riser 202 and has a free end that is towards the middle of the riser 202. FIG. 16 shows an exploded view of the assembly of bow limb 212 to the limb pocket 210. FIG. 17 shows a cutaway view of the assembled bow limb 212 and limb pocket 210. The bow limb pocket 210 includes a pocket area of two sides 216 and a bottom 218 to receive a first end 214 of the bow limb 212. A bow limb rocker 222 is paced between the bow limb 212 and the bottom 218. The bow limb 212 is secured to the bow limb pocket 210 using a screw 224 and washers 226. The bow limb rocker 222 allows for the pressure of the bow limb 212 to be changed by screwing the first end 214 of the bow limb 212 closer to or further from the bottom 218 of the bow limb pocket 210 to adjust the position of the free end of the bow limb 212.

Figure 18:
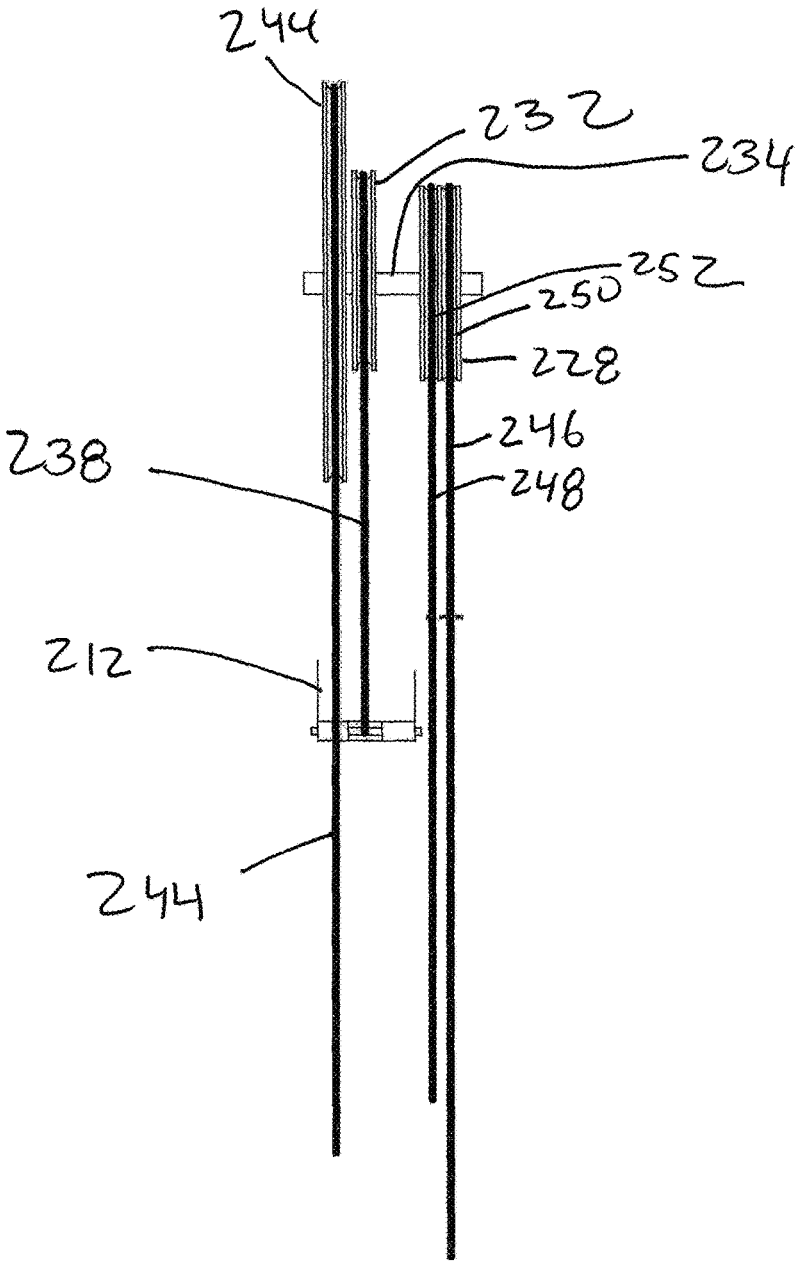
FIG. 18 is a rear view of a bow according to the present invention.
Figure 19:
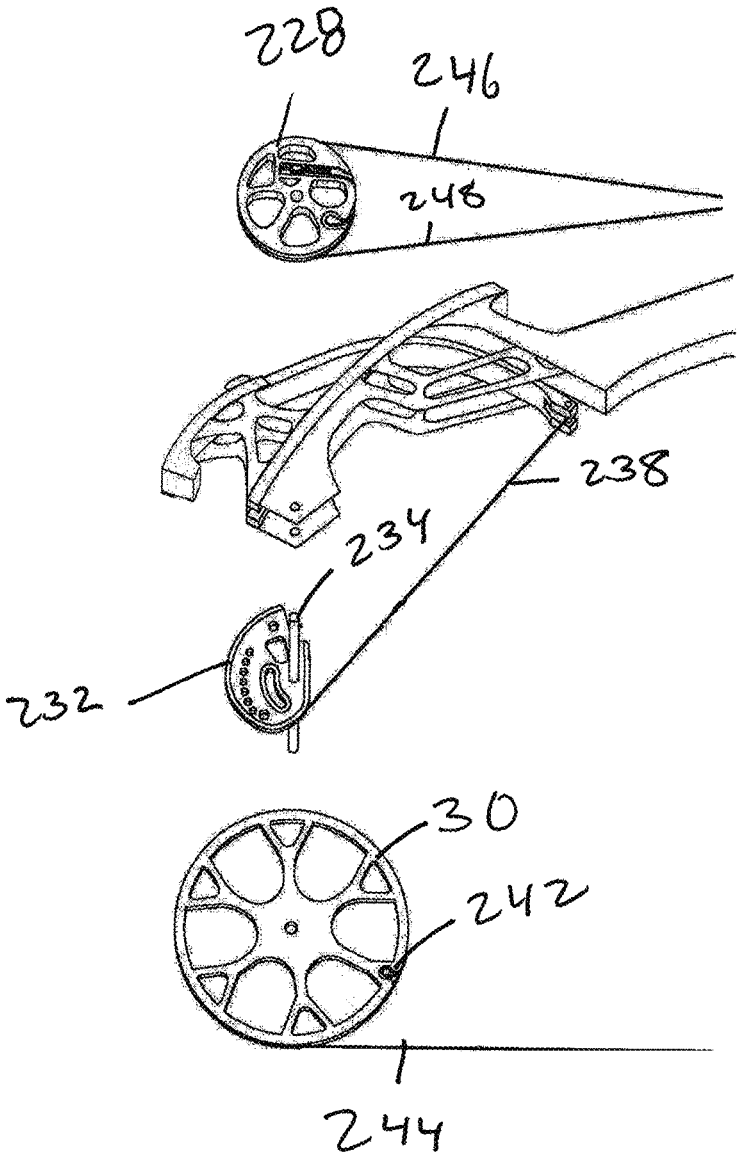
FIG. 19 is a partial exploded view of a bow according to the present invention.
Figure 20:
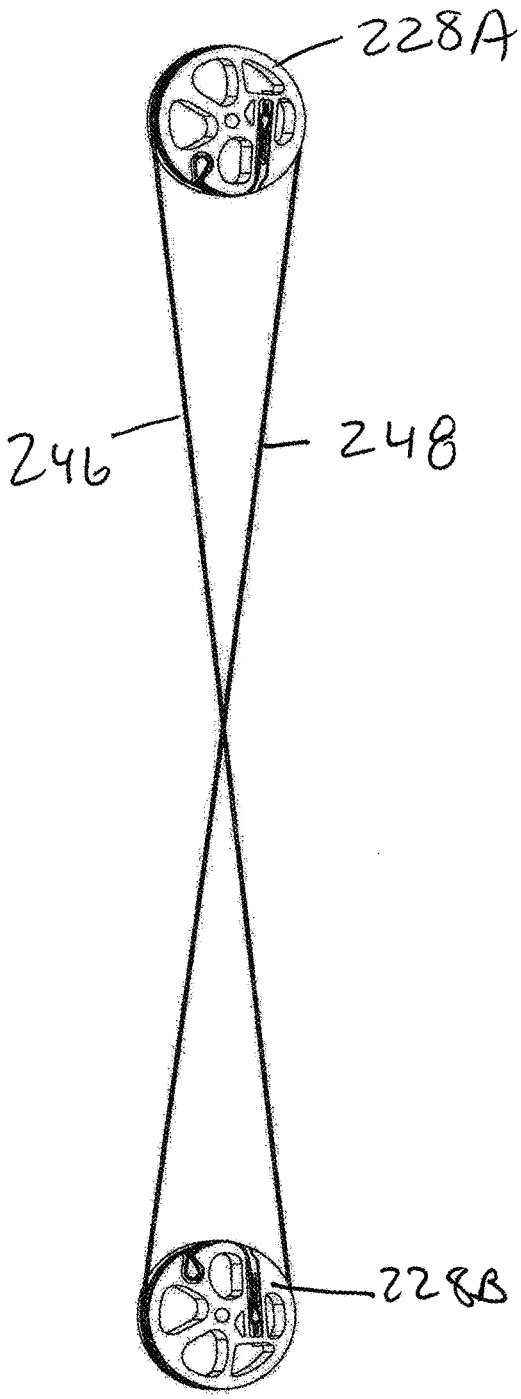
FIG. 20 is a perspective view of a timing wheels according to the present invention.

Each cam-timing assembly includes a timing wheel 228, bowstring wheel 230, cam 232 and driveshaft 234. The driveshaft 234 mounts to between two driveshaft brackets 236 that extend from the riser 202. The two driveshaft brackets 236 act as parallel legs from the riser 202. The driveshaft 234 is mounted such that the driveshaft 234 can rotate between the driveshaft brackets 236. The cam 232, timing wheel 228 and bowstring wheel 230 are attached to the driveshaft 234, as shown in FIGS. 13-14 and 18. The cam 232, timing wheel 228 and bowstring wheel 230 are all fixed to the driveshaft 234 so they all move together in unison and do not rotate about the driveshaft 234 independently. The cam 232 and bowstring wheel 230 are mounted between the driveshaft brackets 236 with the cam 232 on the right side of the bowstring wheel 230, as shown in FIG. 18. The driveshaft 234 extends beyond the driveshaft brackets 236 on the right side. The timing wheel 228 is mounted on part of the driveshaft 234 that extends out from the driveshaft brackets 236. FIG. 15 shows the right side of the riser cam bow 200 without the timing wheels 228. The cam 232 includes a cam cable 238 that is attached between the cam 232 and the second end 240 of the bow limb 212. Note, the bow limb 212 is connected to the cam 232 which is on the same end of the riser 202, where typically the cam is connected by a cable to the bow limb that is on the other end of the riser. As shown in FIG. 19, the bowstring wheel 230 has a string attachment point 242 and the bowstring 244 wraps around the bowstring wheel 230. The amount of bowstring 244 that wraps around the bowstring wheel 230 depends on the length of draw required for the riser cam bow 200.

Figure 21:
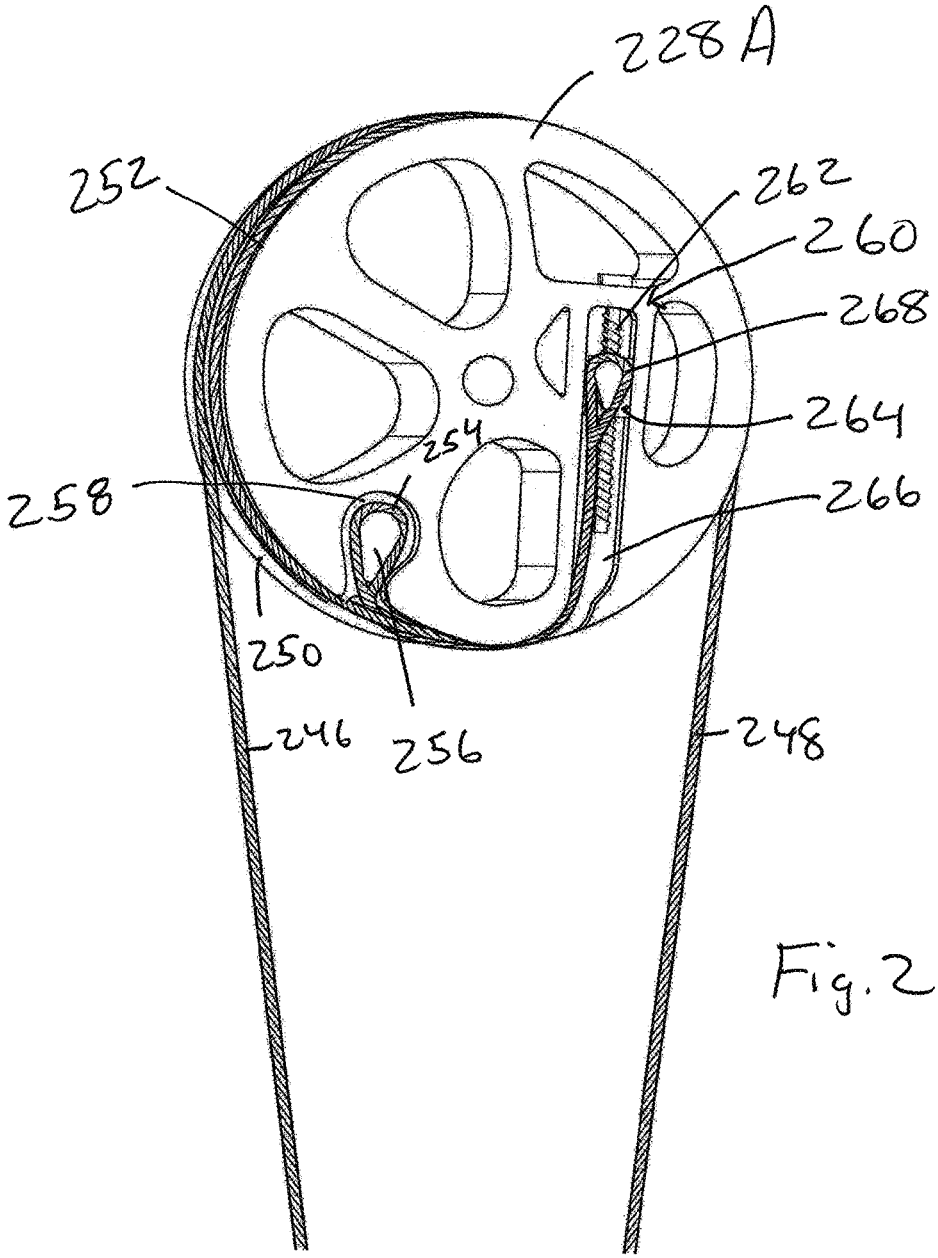
FIG. 21 is a perspective view of a timing wheel according to the present invention.
Figure 22:
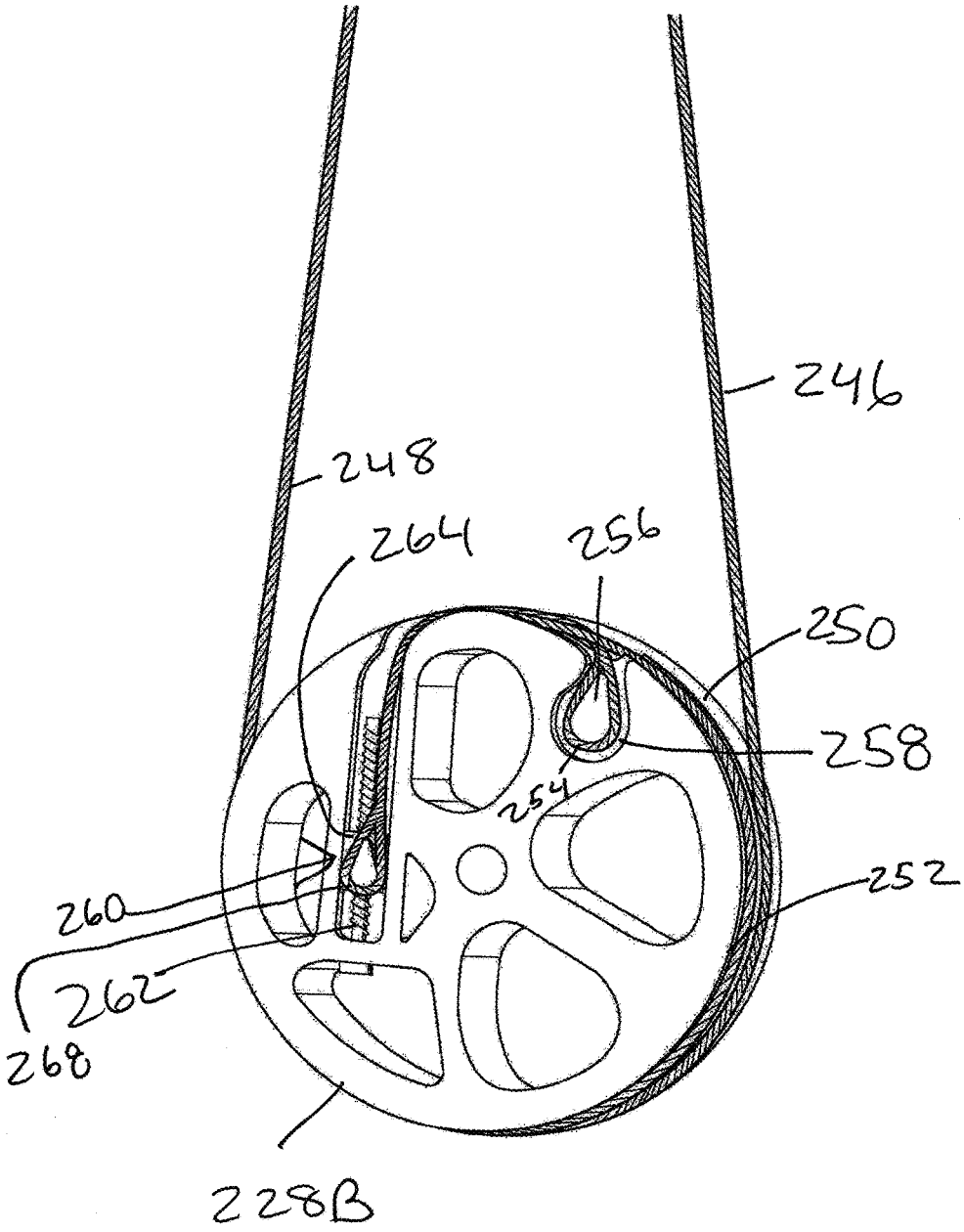
FIG. 22 is a perspective view of a timing wheel according to the present invention.

The first timing wheel 228A and the second timing wheel 228B are interconnected to a first timing cable 246 and a second timing cable 248, as shown in FIGS. 20-23. The first timing wheel 228A and the second timing wheel 228B each include a first cable path 250 and a second cable path 252, which are shown as channels in FIGS. 21-22. The first timing cable 246 includes a first cable loop 254 that is attached to a first cable retainer 256 on the first timing wheel 228A in a fixed retainer slot 258, where the first cable retainer 256 is shown as a loop hook, as shown in FIG. 21. The first timing cable 246 wraps around the first cable path 250 of the first timing wheel 228A and proceeds onto the second timing wheel 228B. The first timing cable 246 includes a second cable loop 268 that attached to a first adjustable cable retainer 260 on the second timing wheel 228B after the first timing cable 246 is wrapped about the first cable path 250 of the second timing wheel 228B, as shown in FIG. 22. The first adjustable cable retainer 260 includes an adjustment screw 262 and adjustment block 264. The adjustment block 264 is attached to the adjustment screw 262 such that the adjustment block 264 moves up and down adjustment screw 262 when the adjustment screw 262 is rotated. The second timing wheel 228B includes an adjustable retainer slot 266 that the adjustment block 264 rides along. The adjustment block 264 moves up and down the adjustable retainer slot 266 during rotation of the adjustment screw 262. The adjustment block 264 includes a loop hook to hold the second cable loop 268. The tension of the first timing cable 246 between the first timing wheel 228A and the second timing wheel 228B is adjusted by changing the position of the adjustment block 264 along the adjustable retainer slot 266 using the adjustment screw 262 on the second timing wheel 228B.

Figure 23:
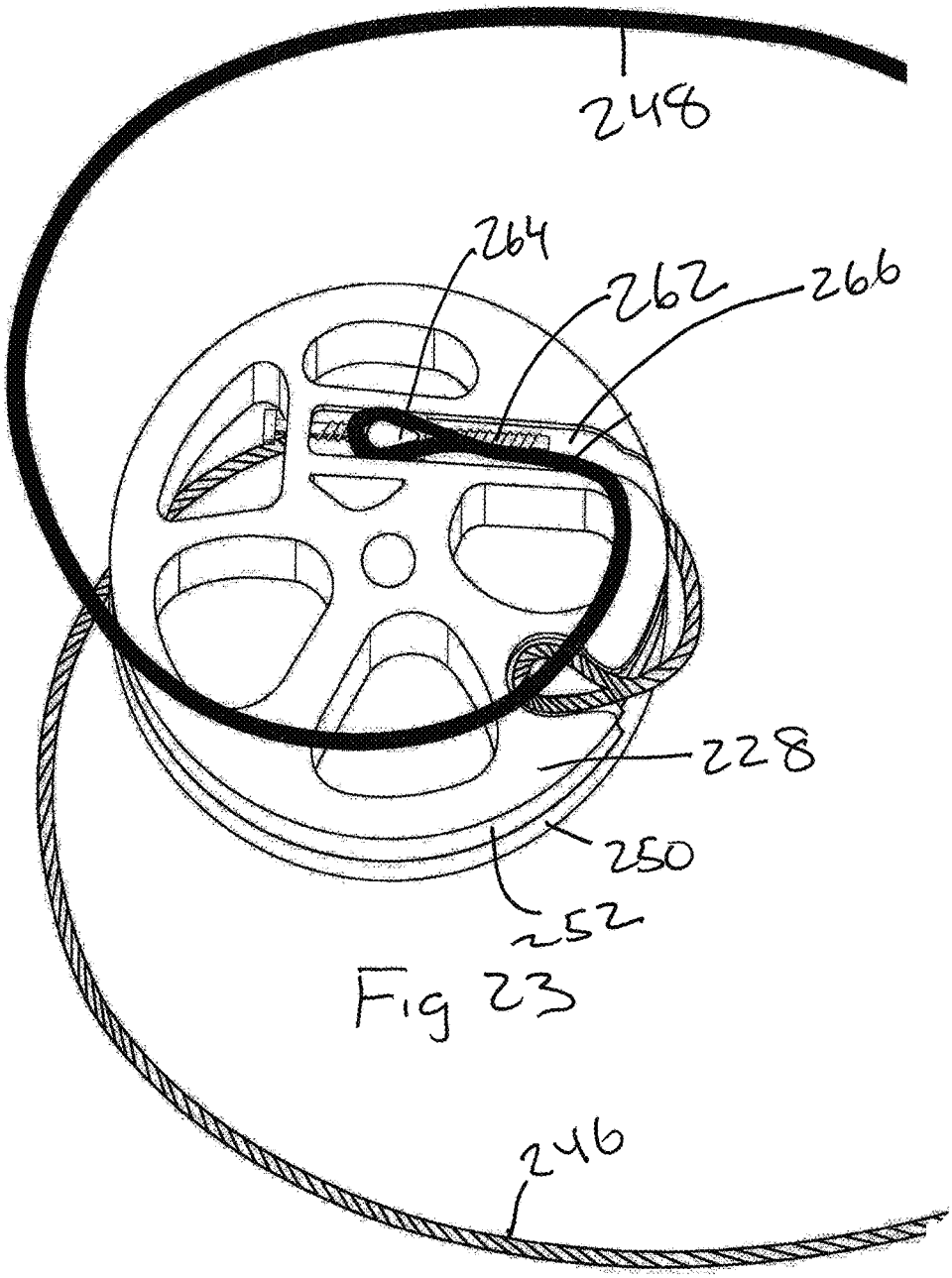
FIG. 23 is a perspective view of a timing wheel according to the present invention.

The second timing cable 248 includes a first cable loop 254 that is attached to a second cable retainer 256 on the second timing wheel 228B in a fixed retainer slot 258, where the second cable retainer 256 is shown as a loop hook, as shown in FIG. 22. The second timing cable 248 wraps around the second cable path 252 of the second timing wheel 228B and proceeds onto the first timing wheel 228A. The second timing cable 248 includes a second cable loop 268 that attached to a second adjustable cable retainer 260 on the first timing wheel 228A after the second timing cable 248 is wrapped about the second cable path 252 of the first timing wheel 228A, as shown in FIG. 21. The second adjustable cable retainer 260 includes an adjustment screw 262 and adjustment block 264. The adjustment block 264 is attached to the adjustment screw 262 such that the adjustment block 264 moves up and down adjustment screw 262 when the adjustment screw 262 is rotated, as shown in FIG. 23. The first timing wheel 228A includes an adjustable retainer slot 266 that the adjustment block 264 rides along. The adjustment block 264 moves up and down the adjustable retainer slot 266 during rotation of the adjustment screw 262. The adjustment block 264 includes a loop hook to hold the second cable loop 268. The tension of the second timing cable 248 between the first timing wheel 228A and the second timing wheel 228B is adjusted by changing the position of the adjustment block 264 along the adjustable retainer slot 266 using the adjustment screw 262 on the first timing wheel 228A.

The operation of the embodiment of the riser cam bow 200 is as follows. The bowstring wheels 230, cams 232, and timing wheel assemblies are mounted on ends of the riser 202. The timing wheels 228 on the end of each driveshaft 234 are synchronize with a crossed set of timing cables 246, 248. The placement of the timing wheels 228 on the outside of the drive shafts 234 provides clearance for launching arrows without having any timing cables that run thru a complicated series of pulleys or cam lean that is found in most compound bows using a cam to bow limb timing system. Where each timing cable 246, 248 is directly connected between the two timing wheels 228. When the bowstring 244 is drawn by the user, the bowstring wheels 230, cams and timing wheel assemblies act in unison to draw and launch an arrow with consistent dead level launches. With the cam 232 not being mounted on the bow limb 212 as in conventional compound bows, the riser cam bow 200 makes very little noise and has virtually no vibration as a result of the cams being stationary and only rotating as the bowstring 244 is drawn and fired. Virtually all compound bows connect a cam to an opposing bow limb using a bow limb cable to keep the bow limbs synchronized and provide a straight line of thrust to the arrow. The problem with this system is that the bow limb cables must be separated from the bowstring to provide clearance for arrows to pass and this leads to tuning issues and synchronization issues. In the present invention, the timing wheel 228 to timing wheel 228 using timing cables 246, 248 that have a direct path to each timing wheel 228 with no other pulleys in between and eliminates cable clearance issues by separating the timing wheels 228 out on the driveshaft 234. As the user draws the bowstring 244, the bowstring wheels 230 rotate, which rotates the cams 232 to wind the bow limb cable 238, which pulls on and compresses the bow limbs 212 in a loaded condition. The timing wheels 228 with the crossed timing cables 246, 248 keeps the two assemblies of the bowstring wheel 230 and cams 232 synchronized. As the bowstring 244 is released the energy from the bow limbs 212 unloading and pulling on the bow limb cables 238 rotates the cams 232 and hence rotates the bowstring wheels 230 to launch the arrow. Most conventional cam to bow limb synchronized bows have issues with level arrow travel, whereby when bowstrings wear and stretch, the timing is affected. The riser cam bow 200 of the present invention does not go out of synchronization. Even if the bowstring 244 stretches the riser cam bow 200 will still be synchronized due to having the timing wheels 228 and cams 232 as presented, whereby the riser cam bow 200 would simply loose speed which can be adjusted by using the bow limb adjustment. The riser cam bow 200 with the cam-timing assemblies of the timing wheel 228, bowstring wheel 230, cam 232 and driveshaft 234 can be utilized on any kind of bow for shooting arrows, including a crossbow. Also, the bow limb can come off the riser in a manner where the ends connected to the cams are outward from the riser instead of the reverse manner shown in the FIGS. 13-15, but with the bracket repositioned on the riser.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

I claim:

1. A riser cam bow adapted being held by a user for shooting an arrow, comprising:

a riser having a first riser end, a second riser end and a middle between said first riser end and said second riser end, said riser having an outside surface that faces towards the direction the arrow will travel and an inside surface that faces the user;

a first bow limb extending from said first riser end, said first bow limb having a first end and a second end, said first end of said first bow limb being attached to said first riser end, said first bow limb attached to said first riser end in a reverse manner, said first end of said first bow limb attaches to said outside surface of said first riser end so that said first bow limb follows along said outside surface of said first riser end towards said middle of said riser and travels past said outside surface and said inside surface such that said second end of said first bow limb is between said inside surface and the user;

a second bow limb extending from said second riser end, said second bow limb having a first end and a second end, said first end of said second bow limb being attached to said second riser end, said second bow limb attached to said second riser end in a reverse manner, said first end of said second bow limb attaches to said outside surface of said second riser end so that said second bow limb follows along said outside surface of said second riser end towards said middle of said riser and travels past said outside surface and said inside surface such that said second end of said second bow limb is between said inside surface and the user;

a first driveshaft bracket extending from said first riser end and a second driveshaft bracket extending from said second riser end;

a first driveshaft rotatably attached to said first driveshaft bracket and a second driveshaft rotatably attached to said second driveshaft bracket;

a first bowstring wheel attached to said first driveshaft in a fixed position and a second bowstring wheel attached to said second driveshaft in a fixed position, said first bowstring wheel being circular and said second bowstring wheel being circular;

a bowstring attached between said first bowstring wheel and said second bowstring wheel, wherein movement of said bowstring causes movement of said bowstring wheels and said driveshafts;

a first cam attached to said first driveshaft in a fixed position and a second cam attached to said second driveshaft in a fixed position, said first cam being non-circular and said second cam being non-circular;

a first cam cable attached between said first cam and said second end of said first bow limb and a second cam cable attached between said second cam and said second end of said second bow limb, wherein rotation of said cams cause compression of said bow limbs;

a first timing wheel attached to said first driveshaft in a fixed position and a second timing wheel attached to said second driveshaft in a fixed position;

a first timing cable, said first timing cable having a first end and a second end, said first timing cable attached between said first timing wheel and said second timing wheel directly to interconnect said timing wheels, said first end of said first timing cable attached to said first timing wheel and said second end of said first timing cable attached to said second timing wheel;

a second timing cable, said second timing cable having a first end and a second end, said first timing cable attached between said first timing wheel and said second timing wheel directly to interconnect said timing wheels, said first end of said second timing cable attached to said second timing wheel and said second end of said second timing cable attached to said first timing wheel; and wherein said bowstring wheels, said cams and said timing wheels move in unison;

wherein rotation of said bowstring wheels causes rotation of said drive shafts, said cams and said timing wheels, wherein rotation of said cams causes rotation of said drive shafts, said bowstring wheels and said timing wheels; wherein said timing wheels prevent unsynchronized movement of said bowstring wheels, and wherein said timing wheels are position on said drive shaft to prevent interference of said timing cables with movement of the arrow.

2. The riser cam bow of claim 1, further including a bracket mounted between each of said first and second riser ends and each of said first bow limb and said second bow limb respectively.

3. The riser cam bow of claim 1, wherein said driveshaft brackets each have two legs and said driveshaft is rotatably mounted in between said legs; wherein said bowstring wheel and cam of each end is mounted on the drive shaft between said legs.

4. The riser cam bow of claim 3, wherein said first timing wheel and said second timing wheel each include a first cable path and a second cable path; wherein said first timing cable is attached to a fixed first cable retainer on said first timing wheel; wherein said first timing cable wraps around said first cable path of said first timing wheel and proceeds onto said second timing wheel; wherein said first timing cable is attached to a first adjustable cable retainer on said second timing wheel after said first timing cable is wrapped about said first cable path of said second timing wheel; wherein said second timing cable is attached to a fixed second cable retainer on said second timing wheel; wherein said second timing cable wraps around said second cable path of said second timing wheel and proceeds onto said first timing wheel; and wherein said second timing cable is attached to a second adjustable cable retainer on said first timing wheel after said second timing cable is wrapped about said second cable path of said first timing wheel.

5. The riser cam bow of claim 4, wherein said adjustable cable retainers includes an adjustment screw and adjustment block, wherein said timing cables are attached to said adjustment blocks; wherein said adjustment screw is attached to said adjustment block to move said adjustment block up and down said adjustment screw when said adjustment screw is rotated to provide tension on said timing cables.

6. The riser cam bow of claim 5, wherein said timing wheels includes an adjustable retainer slot that said adjustment block rides along.

7. The riser cam bow of claim 2, wherein each of said riser ends includes a limb bracket mounted to said riser and extending away from said riser and wherein said bow limbs are attached to said limb bracket.

8. The riser cam bow of claim 7, wherein each of said limb brackets include a limb pocket to receive said bow limbs.

9. A riser cam bow adapted being held by a user for shooting an arrow, comprising:

a riser having a first riser end, a second riser end and a middle between said first riser end and said second riser end, said riser having an outside surface that faces towards the direction the arrow will travel and an inside surface that faces the user;

a first bow limb extending from said first riser end, said first bow limb having a first end and a second end, said first end of said first bow limb being attached to said first riser end, said first bow limb attached to said first riser end in a reverse manner, said first end of said first bow limb attaches to said outside surface of said first riser end so that said first bow limb follows along said outside surface of said first riser end towards said middle of said riser and travels past said outside surface and said inside surface such that said second end of said first bow limb is between said inside surface and the user;

a second bow limb extending from said second riser end, said second bow limb having a first end and a second end, said first end of said second bow limb being attached to said second riser end, said second bow limb attached to said second riser end in a reverse manner, said first end of said second bow limb attaches to said outside surface of said second riser end so that said second bow limb follows along said outside surface of said second riser end towards said middle of said riser and travels past said outside surface and said inside surface such that said second end of said second bow limb is between said inside surface and the user;

a first driveshaft bracket extending from said first riser end and a second driveshaft bracket extending from said second riser end;

a first driveshaft rotatably attached to said first driveshaft bracket and a second driveshaft rotatably attached to said second driveshaft bracket;

a first bowstring wheel attached to said first driveshaft in a fixed position and a second bowstring wheel attached to said second driveshaft in a fixed position, said first bowstring wheel being circular and said second bowstring wheel being circular;

a bowstring attached between said first bowstring wheel and said second bowstring wheel, wherein movement of said bowstring causes movement of said bowstring wheels and said driveshafts;

a first cam attached to said first driveshaft in a fixed position and a second cam attached to said second driveshaft in a fixed position, said first cam being non-circular and said second cam being non-circular;

a first cam cable attached between said first cam and said second end of said first bow limb and a second cam cable attached between said second cam and said second end of said second bow limb, wherein rotation of said cams cause compression of said bow limbs;

a first timing wheel attached to said first driveshaft in a fixed position and a second timing wheel attached to said second driveshaft in a fixed position;

at least one timing cable between said first timing wheel and said second timing wheel; and wherein said bowstring wheels, said cams and said timing wheels move in unison; wherein rotation of said bowstring wheels causes rotation of said drive shafts, said cams and said timing wheels, wherein rotation of said cams causes rotation of said drive shafts, said bowstring wheels and said timing wheels; wherein said timing wheels prevent unsynchronized movement of said bowstring wheels, and wherein said timing wheels are position on said drive shaft to prevent interference of said timing cables with movement of the arrow.

10. The riser cam bow of claim 9, further including a bracket mounted between each of said first and second riser ends and each of said first bow limb and said second bow limb respectively wherein said bow limbs are attached to said riser in a reverse manner so that said first ends of said bow limb attach to said ends of said riser so that said bow limbs follow along said riser from said ends of said riser whereby said second ends of said bow limbs are towards said middle of said riser.

* * * * *